United States Patent [19]

Aberth

[11] Patent Number: 4,851,669

[45] Date of Patent: Jul. 25, 1989

[54] SURFACE-INDUCED DISSOCIATION FOR MASS SPECTROMETRY

[75] Inventor: William Aberth, Palo Alto, Calif.

[73] Assignee: The Regents of the University of California, Berkeley, Calif.

[21] Appl. No.: 201,668

[22] Filed: Jun. 2, 1988

[51] Int. Cl.[4] ..... H01J 49/00

[52] U.S. Cl. ..... 250/281; 250/282

[58] Field of Search ..... 250/281, 282

[56] References Cited

U.S. PATENT DOCUMENTS 4,472,631 9/1984 Enke et al. ..... 250/281

OTHER PUBLICATIONS

McLafferty (1981) Science 214:280–287.
Kondrat and Cooks (1978) Anal. Chem. 50:81A–92A.
Johnson and Biemann (1987) Biochem. 26:1209–1214.
Aberth (1986) Anal. Chem. 58:1221–1225.
Bricker and Russell (1986) J. Am. Chem. Soc. 108:6174–6179.
Mabud et al., (1985) Int. J. Mass Spectrom. Ion Proc. 67:285–294.
Dekrey (1985) Int. J. Mass Spectrom. Ion Proc. 67:295–303.
Bier et al., (1977) Int. J. Mass Spectrom. Ion Proc. 77:31–47.
Schey et al., (1987) Int. J. Mass Spectrom. Ion Proc. 77:49–61.
Wiza (1979) Nuc. Inst. Meth. 162:587–601.
Aberth (1986) Anal. Chem. 58:1221–1225.
Aberth et al., (1982) Anal. Chem. 54:2029–2034.
Aberth et al., (1984) Anal. Chem. 56:2915–2918.
Baldwin (1983) Int. J. Mass Spectrom. Ion Proc. 54:97–107.
Aberth (1980) Biomedical Mass Spectrometry 7:367–371.

*Primary Examiner*—Jack. I. Berman
*Attorney, Agent, or Firm*—Townsend & Townsend

[57] ABSTRACT

A tandem mass spectrometer includes an ion source, a first mass analyzer, a microchannel collision plate, a second mass analyzer, and a detector. The microchannel collision plate comprises a matrix defining a plurality of microchannels which are disposed in a generally parallel orientation with a beam of parent ions emanating from the first mass analyzer. Collision of the parent ions with the internal surfaces of the microchannels causes the parent ions to dissociate into daughter ions. The second mass analyzer distinguishes between various mass fractions of the daughter ions, allowing the detector to quantitate said fractions and produce a mass spectra of the material being analyzed.

21 Claims, 7 Drawing Sheets

SURFACE-INDUCED DISSOCIATION FOR MASS SPECTROMETRY

BACKGROUND OF THE INVENTION

The present invention relates generally to apparatus and methods for performing mass spectrometric analyses of material samples and, more particularly, to an improved technique for dissociating parent ions into daughter ions in tandem mass spectrometers.

Mass spectrometry is an analytical technique which relies on the production of ionized fragments from a material sample and subsequent quantification of the fragments based on mass and charge. Typically, positive or negative ions are produced from the sample and accelerated to form an ion beam. Differing mass fractions within the beam are then selected using a mass analyzer, such as a single-focusing or double-focusing magnetic mass analyzer, a time-of-flight mass analyzer, a quadrupole mass analyzer, or the like. A spectrum of fragments having different masses can then be produced, and the identity of compound(s) within the material sample identified based on the spectrum.

An improved form of mass spectrometry, referred to as tandem or MS/MS mass spectrometry has been developed where a mass-selected ion beam (referred to as the parent ion stream) produced by a first mass analyzer is dissociated into a plurality of daughter ion fragments. The daughter ion fragments are then subjected to a second stage mass analyzer, allowing mass quantification of the various daughter ion fractions. Such tandem mass spectrometry has been found to provide much more information on the material being analyzed and to allow for improved discrimination between various species that may be present in a particular sample. Tandem mass spectrometry is discussed in more detail in McLafferty (1981) Science 214:280–287 and Kondrat and Cooks (1978) Anal. Chem. 50:81A–92A.

The present invention is concerned primarily with methods and apparatus for dissociating the parent ion beam into a beam of daughter ions. Collision-induced dissociation (CID) is generally employed to reduce the parent ions into the daughter ions. In the predominant technique, the mass-selected parent ions are collided with gas particles, such as helium or hydrogen particles, to convert a portion of the translational energy into internal excitation energy. A number of the excited molecules will then undergo rapid unimolecular dissociation into structurally significant fragment ions, referred to as daughter ions.

The use of a gas to induce collisional dissociation has several drawbacks. First, very small sample sizes, on the order of micrograms, are generally too small to provide sufficient parent ions to produce a significant stream of daughter ions. Second, the daughter ions are frequently produced over a very large energy range as a result of the kinetics of the gas collision. Such a large energy spread may necessitate the use of double focusing analyzers to obtain sufficient resolution of the daughter ion spectrum. Even with the best performing tandem equipment, however, the highest practical resolution is usually limited to about 1000 daltons because of the signal loss resulting from the broad energy differential. See, e.g., Johnson and Biemann (1987) Biochem. 26:1209–1214. The introduction of a collision gas can also raise the pressure in the mass spectrometer which can result in poor resolution of high mass, e.g., greater than 1000 d, compounds. See, e.g., Aberth (1986) Anal. Chem. 58:1221–1225. Finally, tandem mass spectrometers using electrostatic energy analyzers often display uncertainty in mass calibration as a result of collision-associated translational energy loss. See, e.g., Bricker and Russell (1986) J. Am. Chem. Soc. 108:6174–6179.

To at least partially overcome these problems, a technique referred to as surface-induced dissociation (SID) has been introduced. See, e.g., Mabud et al. (1985) Int. J. Mass Spectrom. Ion Processes 67:285–294; Dekrey (1985) Int. J. Mass Spectrom. Ion Processes 67:295–303; Bier et al. (1977) Int. J. Mass Spectrom. Ion Processes 77:31–47; and Schey et al. (1987) Int. J. Mass Spectrom. Ion Processes 77:49–61. The technique involves colliding a mass-selected low kinetic energy (less than 200 eV) molecular ion beam off a smooth metal surface and mass analyzing the resulting fragments. The object of the technique is to increase the energy transferred to the parent ions to improve their fragmentation efficiency and to avoid certain of the disadvantages of the gas CID method. Unfortunately, SID also suffers from a number of drawbacks. While large amounts of energy can be transferred to the molecular ions for effective fragmentation, the method is only successful with relatively low mass (less than 250 d) hydrocarbons and no fragmentation spectra of biocompounds have yet been reported. In particular, the method has been ineffective with high mass biological polymers, such as proteins, carbohydrates, and polynucleotides, because the high collision energy degrades the individual monomer units, rendering analyses difficult or impossible. Additionally, the collection efficiency (mass of daughter ions collected/mass of parent ions) with tandem mass spectrometers employing SID is relatively low, seldom exceeding 5%. Such low collection efficiency requires use of a larger sample size, which may not always be available. Finally, SID requires about a 90 degree difference between the direction of the incoming parent ion beam and that of the reflected daughter ion beam. As practically all exiting tandem spectrometers use a gas cell for collisional dissociation, they require an in-line geometry between the incoming parent and outgoing daughter beams. Thus, substitution or retrofitting of SID apparatus will require radical restructuring of existing instruments.

For the above reasons, it would be desirable to provide improved methods for collision-induced dissociation of mass-selected ion beams in tandem mass spectrometers. In particular, it would be desirable to maintain the relatively high energy associated with conventional SID methods, while allowing application to a broad range of compounds, including relatively high molecular weight biological compounds. Moreover, it is desired that it be readily adaptable to existing tandem instrument designs where the first and second mass analyzers are aligned in an in-line geometry. Finally, it would be particularly desirable to provide CID with relatively high collection efficiencies, preferably about 10%.

SUMMARY OF THE INVENTION

The present invention is an improved technique for providing collisional dissociation of parent ions in tandem mass spectrometric analysis of a material sample. Parent ions are selected from a primary ion source by a first mass analyzer, and the parent ion stream is then collided with a collision plate defining an array of microchannels therethrough. The plate is oriented so that the center line of the parent ion beam enters the microchannels at an approach angle between about 0° and 10°, and collision between the parent ions and the internal surfaces of the microchannel imparts internal energy to the ions. The energized ions then dissociate into daughter ions which pass through a second mass analyzer prior to detection.

The use of the microchannel plate of the present invention has a number of advantages over previous CID and SID methods. In particular, by adjusting the approach angle at which the beam strikes the collision plate, the energy imparted to the parent ions can be carefully controlled. By decreasing the angle and reducing the imparted energy, even complex biological polymers can be analyzed without substantial degradation of the individual monomer units. Additionally, the use of the microchannel collision plate is compatible with high resolution magnetic mass analyzers which produce relatively narrow incident ion beams. The parent ion beams produced by magnetic mass analyzers may further be subjected to deceleration prior to striking the collision plate, allowing further adjustment of the energy imparted to the ions by collision. Finally, by axially aligning the microchannels with or close to the center line of the incoming parent ion beam, the parent ions can maintain a relatively large translational energy while a much lower amount of collisional energy is imparted to the molecule (the energy which is associated with the velocity component normal to the channel surface). Thus, spreading of the resultant beam of daughter ions is minimized, allowing higher collection efficiencies in the second mass analyzer.

DESCRIPTION OF THE SPECIFIC EMBODIMENTS

Figure 1:
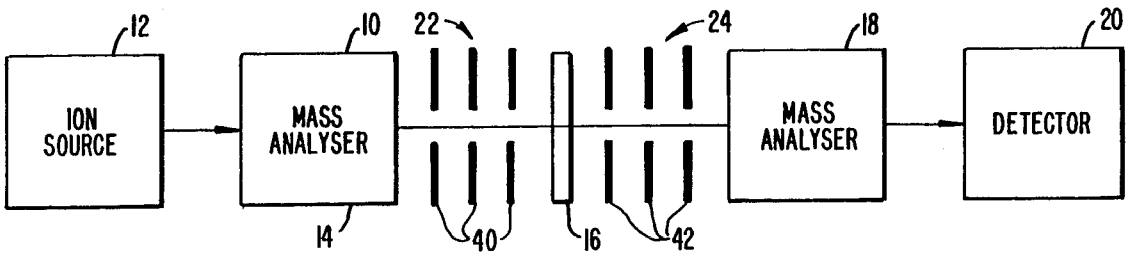
FIG. 1 is a block diagram of a tandem mass spectrometer employing the microchannel collision plate of the present invention.

Mass spectrometer systems 10 according to the present invention are generally configured as illustrated in FIG. 1, and includes an ion source 12, a first mass analyzer 14, a microchannel collision plate 16, a second mass analyzer 18, and a detector 20. Optionally, system 10 may also include a first beam accelerator 22 (usually a negative accelerator, i.e., a decelerator) upstream of the microchannel collision plate 16 as well as a second beam accelerator 24 (usually a positive accelerator) downstream of the collision plate.

The ion source 12 is capable of providing a primary ion beam composed of molecules from a material sample to be analyzed. The first mass analyzer 14 is arranged to receive primary ions from the ion source 12 and to select particular mass fractions thereof, producing a parent ion beam. The parent ion beam then strikes microchannels 30 (FIG. 2) formed within the microchannel collision plate 16 (as described in more detail hereinafter), whereby the collision causes dissociation of the parent ions into smaller fragments, referred to as daughter ions. The second mass analyzer 18 receives the beam of daughter ions from the microchannel collision plate 16, and is able to select a desired mass fraction thereof. The detector 20 collects and quantifies differing mass fractions of daughter ions selected by the second mass analyzer 18, and is able to produce a mass spectrum of the daughter ions which will be characteristic of the material sample being analyzed. The decelerating lens 22 and accelerating lens 24 are utilized to control the translational energy of the parent ion beam striking and exiting the microchannel collision plate 16, allowing direct control over the degree of fragmentation of the parent ions.

The ion source 12, first mass analyzer 14, second mass analyzer 18, and detector 20 may be conventional components of a type generally employed in tandem mass spectrometry systems available today. The microchannel collision plate 16 and associated decelerator lens 22 and accelerator lens 24, however, are unique to the present invention and will be described in much greater detail hereinbelow. Prior to such description, the requirements of the conventional components of the system will be briefly described.

The ion source 12 may be any conventional component capable of ionizing, accelerating, and focusing ions from gas, liquid, or solid material samples. Most commonly, the ion source 12 will utilize electron impact where a volatilized sample is bombarded by an electron beam to form radical cations and anions. The ionic species thus produced are usually electrostatically transferred to an ion tube, where they may be accelerated and focused using conventional apparatus. Alternatively, chemical ionization may be utilized where the volatilized sample is reacted with an ionized reactant gas, such as methane. The volatilized sample molecules are then ionized by collision with the ionized reactant gas, and the resulting ionized molecules are accelerated and focused by conventional techniques. A third technique, referred to as field ionization, produces ionic species by subjecting sample in the vapor phase to a strong electric field which can form positive ions. Field desorption is a similar technique where the sample is deposited on an anode surface and subsequently ionized and desorbed from the surface. A further common technique called FAB (fast atom bombardment) or liquid SIMS (secondary ion mass spectrometry) utilizes an energetic (2–35 keV) neutral or ionic beam directed at a target composed of the sample material dissolved in a viscous liquid solvent. The resultant sputter ions, including those of the sample material, are then formed into a beam and mass analyzed. All of these techniques for producing a primary ion beam useful in the system of the present invention are well known and amply described in the scientific and patent literature.

The first and second mass analyzers 14 and 18 may be of the same or different type, and will generally comprise conventional components, such as magnetic mass analyzers, quadrupole mass analyzers, time-of-flight mass analyzers, and ion-cyclotron resonance mass analyzers. The mass analyzers are required to receive an incident ion beam, either the primary ion beam from ion source 12 or the daughter ion beam from the microchannel collision plate 16, and select a particular fraction of the incident beam based on mass or mass-charge ratio. The use of magnetic mass spectrometers, particularly double-focusing mass spectrometers, is generally preferred for high mass and high resolution analyses. Double-focusing mass spectrometers incorporate both electrostatic and magnetic analyzers and are capable of very high resolution, allowing separation of molecule fragments in a range of 10,000 daltons (d). Moreover, in contrast to surface-induced dissociation using a solid metal plate as described above, the use of a microchannel collision plate according to the present invention is compatible with magnetic mass analyzers, particularly double-focusing mass analyzers, which produce a relatively narrow beam width.

Detectors 20 usable in the mass spectrometry system 10 of the present invention generally include Faraday cup detectors and electron multipliers. The detectors 20 are used to allow the plotting of mass spectra showing the relative abundance of species having a particular mass or mass-to-charge ratio. Mass spectra produced by the method of the present invention are illustrated in FIGS. 6–11, described in detail in the Experimental section hereinafter.

Figure 2:
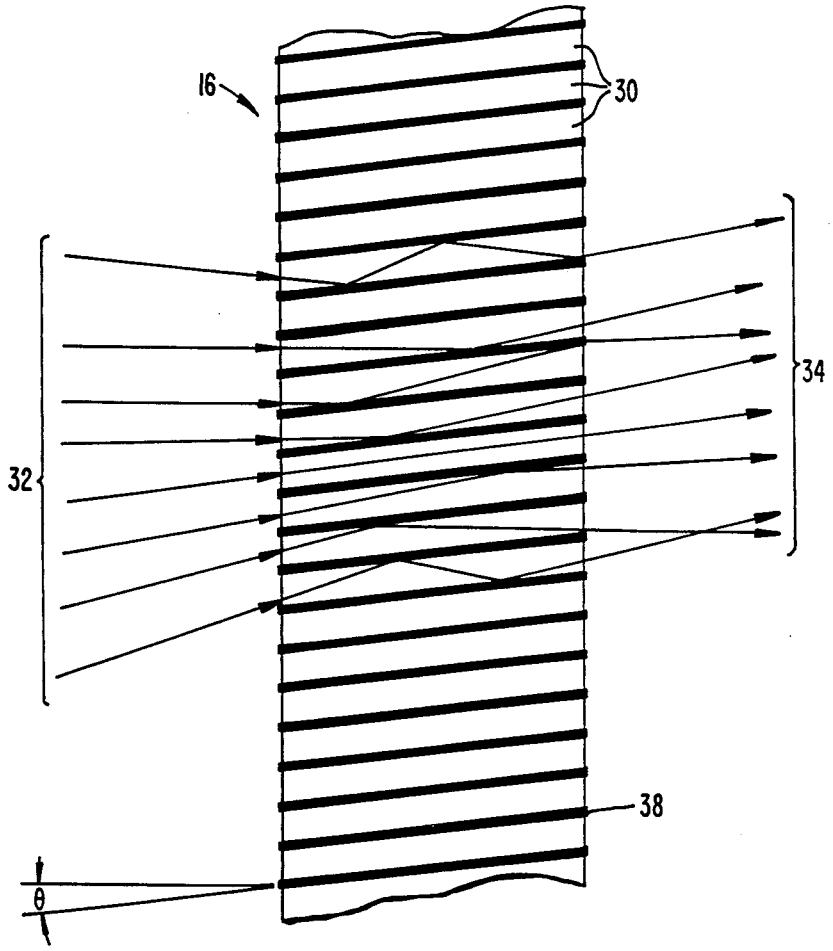
FIG. 2 is a schematic illustration of a beam of parent ions striking a microchannel collision plate according to the present invention.

Referring now in particular to FIG. 2, the requirements of a microchannel collision plate 16 suitable for use in the present invention will be described in detail. Most generally, the collision plate 16 is a matrix defining a plurality of transverse, open microchannels 30 capable of receiving individual ions from an incident ion beam 32 and, after the ions collide with the interior surface of the microchannels, releasing an ion beam 34 of daughter ions which are dissociation fragments of the parent ion beam 32. The microchannel collision plate 16 will be composed of a high resistance material, such as lead glass, but will include electrically conductive surfaces 36 and 38 on opposite faces of the plate 16. The faces 36 and 38 will be electrically coupled in the mass spectrometry system 10 so that there is essentially no voltage drop across the microchannel collision plate 16. The use of a high resistance material for the microchannel plate is important since it reduces charge neutralization which would occur during collision between the ionic species and a conductive surface, such as a metallic surface. Such charged neutralization is a significant problem when employing collision-induced dissociation with a metal surface, according to the teachings of the prior art.

The microchannel collision plate 16 will generally have parallel surfaces, usually being a flat plate, although curved plates and plates having non-parallel surfaces may find use in particular applications, e.g., use of the plate 16 for optically focusing the emanating beam of daughter ions 34.

The dimensions of the microchannel collision plate 16 are not critical and will generally be sufficient to allow mechanical manipulation of the plate within the mass spectrometry system 10. The microchannels 30, however, need only be formed on a portion of the plate 16 and will usually cover an area of at least about 1 $mm^2$, frequently covering an area of at least about 5 $mm^2$, and often being at least 10 $mm^2$ or greater. The microchannels 30 may form a circular, rectangular, or other geometry target on the surface of plate 16. Frequently, the microchannels 30 will form a rectangular target having a width of several millimeters and a length of about 1 centimeter in order to receive an incident ion beam which has been focused through a slit.

The microchannels 30 will extend through the collision plate 16 and will be open at each end in order to allow entry of the parent ion beam 32 and exit of the daughter ion beam 34. Of course, only a portion of the parent ion beam will actually be fragmented, so the exiting beam 34 will include both daughter ions as well as intact parent ion species. Because of the manner of fabrication (as described in more detail hereinbelow), the microchannels 30 will generally have a circular cross-section. There is no reason, however, why other cross sections, such as square, triangular, rectangular, or irregular, might not also find use. The diameter or width of the microchannels 30 will generally be in the range from about 1 to 100 $\mu$m, frequently being in the range from about 2 to 50 $\mu$m, and typically being in the range from about 5 to 25 $\mu$m. The microchannels 30 will generally be arranged to lie parallel to one another, although this is not a requirement and some axial deviation would be permitted. Generally, the microchannels 30 are arranged in the plate 16 so that they will lie generally parallel or at a slight bias, typically plus or minus 10°, relative to the mean axis of the incident beam 32. As illustrated in FIG. 2, an approach angle $\theta$ of about 10° is illustrated.

The microchannels 30 will generally have a linear axis, but non-linear microchannels may also be employed. Usually, non-linear microchannels will be arcuate (evenly curved). Irregularities on the internal surface of the microchannel 30 may well reduce the efficiency of ion transport through the collision plate 16. Additionally, such irregularities will cause an undesirable broadening of the range of energies which the daughter ions are released.

The length of microchannels 30 will depend primarily on their width, typically being at least about 50 $\mu$m, usually being in the range from about 250 $\mu$m to 5 mm, more usually being in the range from about 100 $\mu$m to 1 mm. The ratio of microchannel length to width (diameter) will typically be at least about 25, usually being at least about 40, and more usually being at least about 50.

As illustrated in FIG. 2, the incident parent ion beam 32 includes a number of individual ions which are oriented at angles which result in collision with the interior surfaces of the microchannels 30 after they enter the collision plate 16. Depending on the relative angle, and on the nature of the collision, i.e., elastic or inelastic, the incident ions may undergo one, two, three, or more collisions with the microchannel wall. During these collisions, sufficient internal energy will be acquired by at least some of the parent ions to result in dissociation into the desired daughter ions. The relative or approach angle $\theta$ will be chosen depending on the energy required to dissociate the parent ions. Generally, smaller refractory-type ions require higher energy levels in order to provide the desired molecular dissociation. Larger molecules, particularly biological polymers such as proteins, nucleic acids, carbohydrates, and the like, will generally require lower internal energy as it is desired only to break the relatively weak bonds between adjacent monomer units. Generally, collision with the interior surface of the microchannels will provide an internal energy in the range from about 0.1 to 100 eV, usually in the range from about 1 to 50 eV, and typically in the range from about 2 to 30 eV. For smaller molecules, higher energies in the range from about 5 to 40 eV will be preferred, while for larger molecules, lower energies in the range from about 2 to 20 eV will be preferred.

Microchannel collision plates suitable for use in the present invention may be formed from lead glasses by glass fiber drawing techniques of the type used in the fabrication of microchannel plate arrays used as electron multipliers. The preparation is amply described in the scientific and patent literature. See, for example, Wiza (1979) Nuc. Inst. Meth. 162:587–601, and the references cited therein. Conveniently, commercially-available microchannel plates available from suppliers, such as Varian and Galileo Electro-Optics, Corp. may be utilized in the present invention.

Referring again to FIG. 1, the first accelerating lens 22 will generally employ a plurality of individual conductive plates 40 arranged in a conventional manner of a focusing lens. The plates 40, as well as the conductive surface 36 of collision plate 16 will usually be electrically biased in order to reduce the energy of the incident beam 32 of parent ions. Typically, the parent ions striking the collision plate 16 will have an energy in the range from about 100 to 2000 eV. Similarly, the second accelerating lens 24 will also include a plurality of plates 42 arranged as a focusing lens, usually being electrically biased together with conductive surface 38 of collision plate 16 in order to increase the energy and focus the daughter ion beam 34 released from the plate 16.

Figure 3:
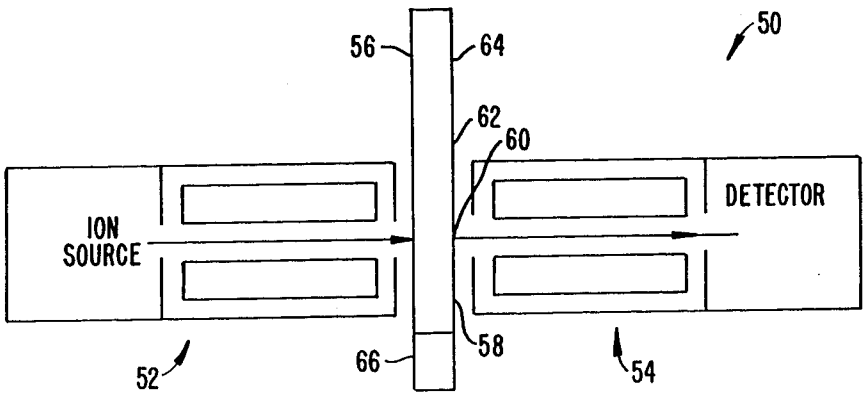
FIG. 3 is a block diagram of an alternate configuration of a mass spectrometer constructed in accordance with the principles of the present invention.

Referring now to FIG. 3, an alternate embodiment 50 of the mass spectrometry system of the present invention will be described. The system is essentially the same as that described in reference to FIG. 1, except that a first quadrupole mass analyzer 52 and second quadrupole mass analyzer 54 are utilized. Additionally, the system 50 can employ a microchannel collision plate 56 which includes a multiplicity of distinct microchannel regions identified by reference numerals 58, 60, 62, and 64. In the first microchannel region 58, the individual microchannels are arranged with their axes generally normal to the flat surface of plate 56. Subsequent regions 60, 62, and 64 each have an increased bias angle, so that they will generally provide increased internal energy to the incident parent ions. An open region 66 is also provided so that parent ions may be directed to the second quadrupole analyzer 54 without dissociation.

Because of the low beam energy utilized in quadrupole instruments, it may be desirable to provide positive acceleration through the first accelerator 22 in order to supply sufficient energy for collisional dissociation within the microchannels 30. Similarly, deceleration by accelerator 24 may be required when the second mass analyzer 18 is a quadrupole instrument.

Figure 4:
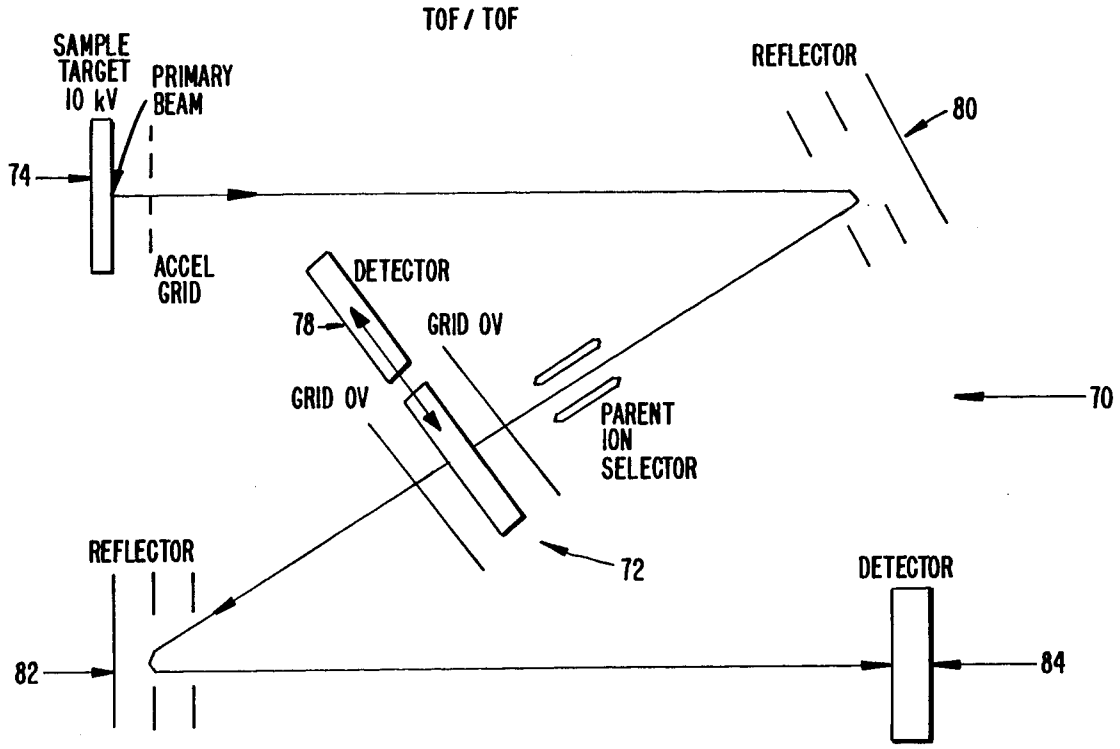
FIG. 4 is a second alternate embodiment of a mass spectrometer constructed in accordance with the principles of the present invention.

A second alternative embodiment 70 of the mass spectrometry system of the present invention is illustrated in FIG. 4. System 70 employs conventional time-of-flight mass analyzers in combination with a microchannel plate 72 constructed in accordance with the principles of the present invention. In this tandem time-of-flight (TOF/TOF) system 70, a pulsed primary beam ejects sample ions from a flat target surface 74. These ions are accelerated to a fixed energy by means of a grid 76 and with detector 78 intercepting the beam, the time of flight of the ions from the target to the detector is measured. This time spectrum is correlated with the mass spectrum since the heavier ions will move slower than the light ions. Reflectors 80 and 82 serve to energy focus the ions, thereby maintaining good resolution. By providing a strong deflecting voltage on the plates of a parent ion selector 84, except during the period when the desired parent molecular ion passes, only ions of the desired mass will reach detector 78. Replacing detector 78 with the microchannel plate 72 of this invention will now produce the daughter ions which can be TOF separated and detected by detector 84.

The following examples are offered by way of illustration, not by way of limitation.

EXPERIMENTAL

Figure 5:
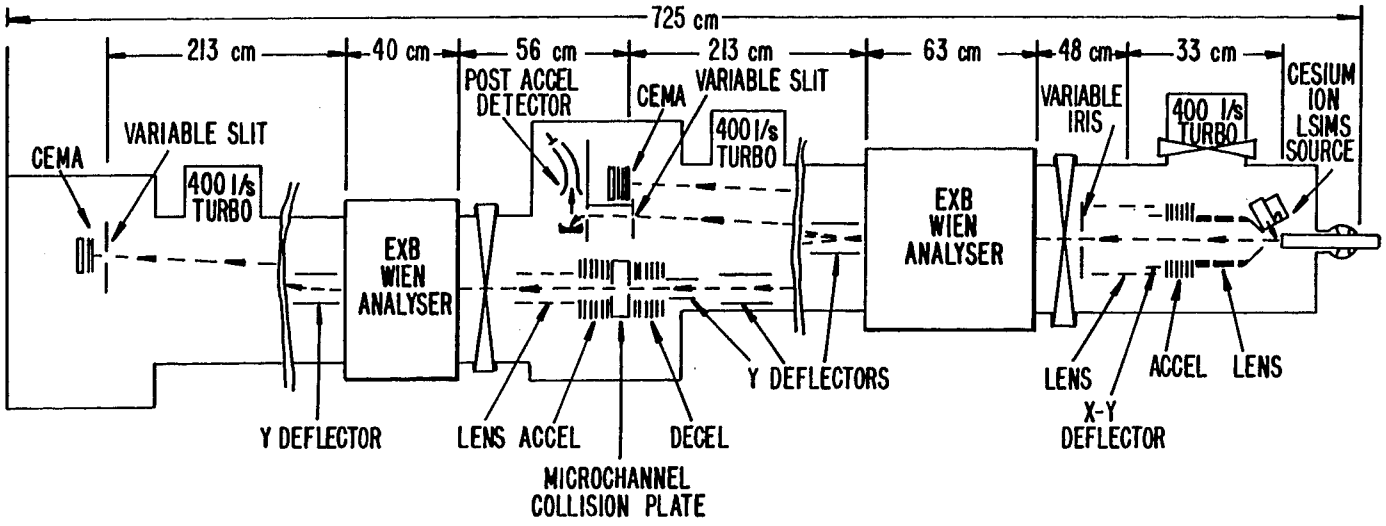
FIG. 5 illustrates the mass spectrometer employed in the examples set forth in the Experimental section hereinafter.

The experimental arrangement for demonstrating the present invention is shown in FIG. 5. A tandem Wien mass spectrometer (Aberth (1980) Biomed. Mass Spectrom. 7:367–371, and (1986) Anal. Chem. 58:1221–1225) operating with an accelerating voltage of 25 kV was used. The Wien spectrometer utilizes superimposed electric (E) and magnetic (B) fields to mass separate beam ions. The ion source utilizes a 10 keV cesium ion gun (Aberth et al. (1982) Anal. Chem. 54:2029–2034) to sputter sample molecular ions either from a liquid glycerol matrix containing the dissolved sample material, (see FIGS. 6–9), or from a solid surface coated with the sample compound (see FIGS. 10,11). Ions were extracted from the source using an immersion lens geometry (Aberth and Burlingame (1984) Anal. Chem. 56:2915–2918), and accelerated to 25 keV for mass separation by Wien MS-1. The mass selected ion beam was then decelerated from 25 keV to the desired energy for dissociation by the microchannel plate.

The microchannel plate was a portion of a Varian Model VUW 8946ES plate mounted behind a ⅛ inch diameter aperture. The plate contained an array of channels 9.6 microns in diameter and 432 microns long with an open area ratio of 59%. The microchannel plate was externally rotatable and for the results shown here was aligned so that the microchannel axes differed by about 3 degrees from the center-line of the striking parent beam. Increasing this angular difference tended to increase fragmentation at the lower portion of the mass spectrum.

Figure 10:
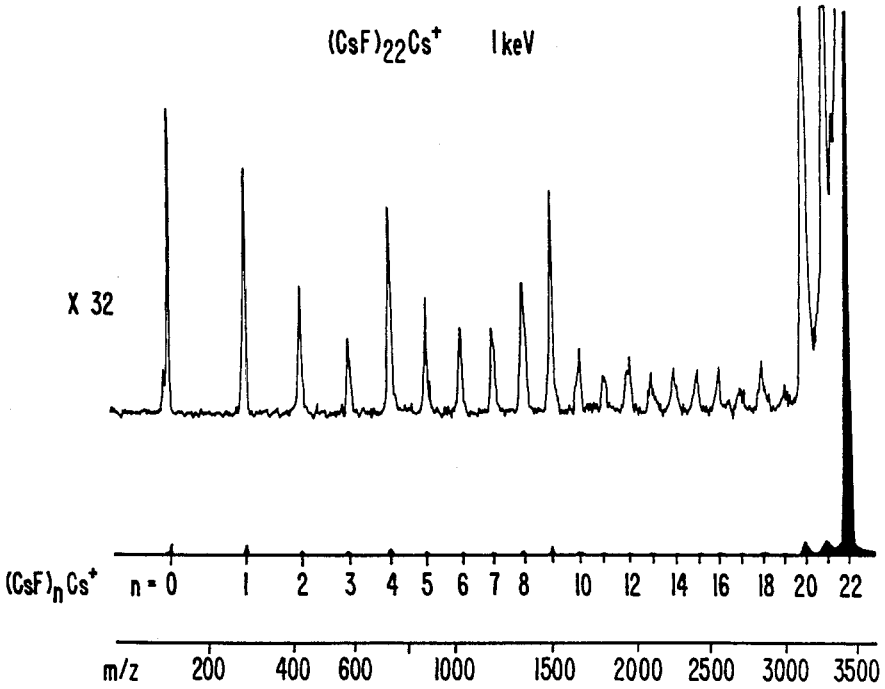
Figure 11:
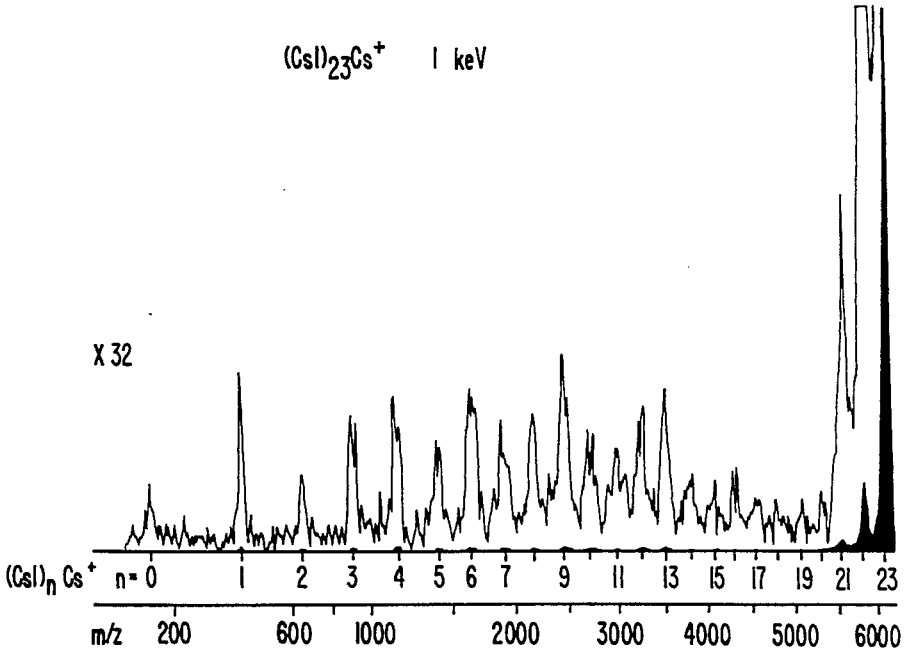

The resolution of Wien MS-1 was set at 500 (full width at half maximum) while that of Wien MS-2 was about 80. The relatively low resolution of Wien MS-2 limited useful mass analysis to about 1000d for complex biological compounds (FIGS. 6–9) but permitted considerably higher mass analysis for the simpler alkali-halides (FIGS. 10,11).

Figure 6:
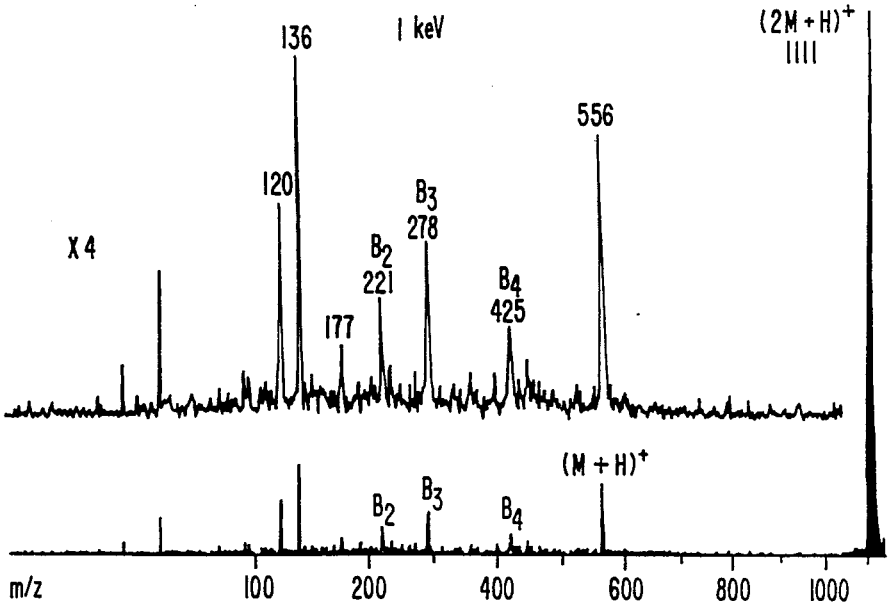
FIGS. 6–11 are mass spectrums of different molecules produced by the experimental mass spectrometer of FIG. 5.
Figure 7:
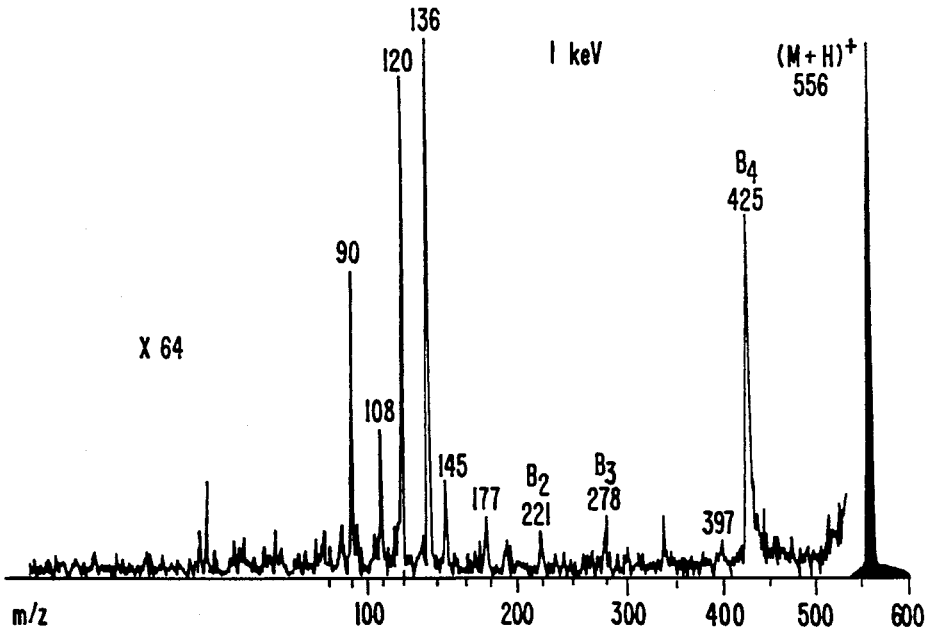
Figure 8:
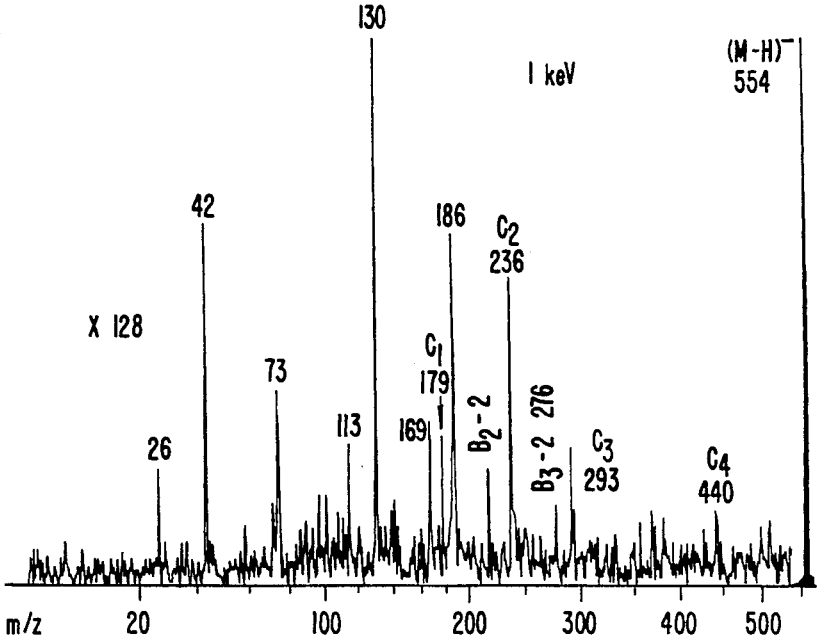
Figure 9:
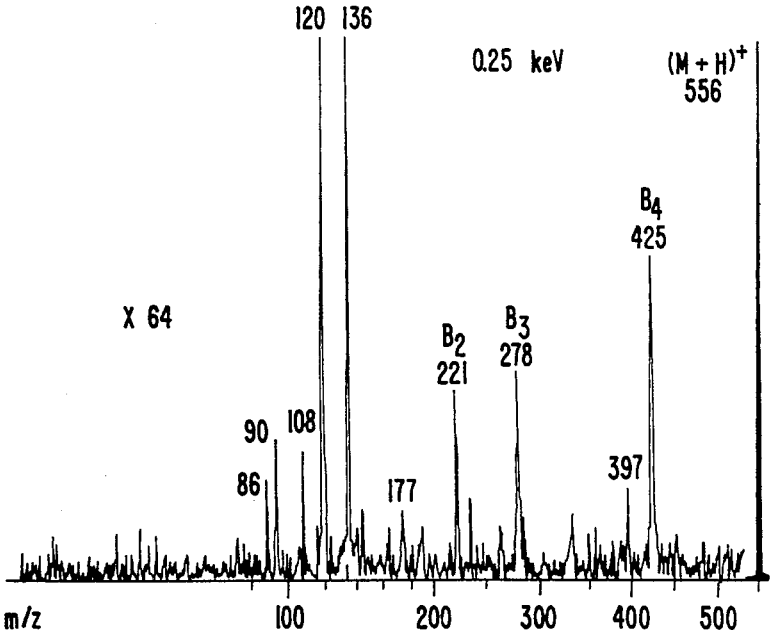

FIGS. 8 and 7 show the respective negative and positive spectra of leucine enkephalin (555d), a peptide containing 5 amino acids, obtained by decelerating the parent beam to 1000 eV. Good sequence information is obtained in the negative spectrum (FIG. 8), however, in the positive spectrum (FIG. 7) the $B_2$ and $B_3$ peaks are not strong. Reducing the energy of the parent ion to 250 eV (FIG. 9) greatly improves the sequence structure of the positive ion spectrum and demonstrates the ease with which the microchannel dissociation technique of the present invention can be controlled. FIG. 6 shows a spectrum of the dimer leucine enkephalin (1111d) and demonstrates the high mass capability of the spectrometer employing a microchannel plate. Note the expected lack of fragmentation between the dimer and monomer molecular ion peaks and the high percentage of fragmentation (50%) at masses below that of the monomer. FIG. 10 is a spectrum of the $(CsF)_{22}Cs^+$ (3477d) cluster ion demonstrating the high level of detail and the sensitivity of detection at lower masses achievable by the technique of the present invention. FIG. 11 shows the ability of the present invention to analyse very high masses. The complete fragmentation spectrum of $(CsI)_{23}Cs^+$ (6113d) is shown, including all possible cluster ion fragments from n=0 to 23 of $(CsI)_nCs^+$. These results represent about 20% fragmentation and are a considerable improvement over previous CID analysis of cesium ion clusters as reported by Baldwin (1983) Int. J. Mass. Spectrom. Ion Proc. 54:97–107.

Although the foregoing invention has been described in some detail by way of illustration and example for purposes of clarity of understanding, it will be obvious that certain changes and modifications may be practiced within the scope of the appended claims.

What is claimed is:

1. A mass spectrometer comprising:

means for generating a primary ion beam from a material sample;

first mass analyzing means for selecting a beam of parent ions from the primary ion beam;

a collision plate defining an array of microchannels disposed to receive at least a portion of the beam of parent ions, whereby collision of the parent ions with interior surfaces of the microchannels dissociates the parent ions into smaller daughter ions;

second mass analyzing means for selecting a mass fraction of the beam of daughter ions; and means for detecting the selected mass fraction of the daughter ions.

2. A mass spectrometer as in claim 1, further comprising:

first means for accelerating the parent ions between the first analyzing means and the collision plate; and second means for accelerating the daughter ion beams from the collision plate.

3. A mass spectrometer as in claim 1, wherein the microchannels have a width in the range from about 1 to 100 μm.

4. A mass spectrometer as in claim 3, wherein the microchannels have a length to width ratio of at least about 25.

5. A mass spectrometer as in claim 1, wherein the microchannels are substantially straight.

6. A mass spectrometer as in claim 1, wherein the microchannels are curved.

7. A mass spectrometer as in claim 5, wherein the microchannels are substantially parallel to one another.

8. A mass spectrometer as in claim 7, wherein the axes of the microchannels are at an angle from about 0° to 10° relative to the direction of the incident primary beams.

9. A mass spectrometer as in claim 1, wherein the first mass analyzing means is one of the group consisting of a double focusing mass analyzer, a time-of-flight mass analyzer, and a quadrupole mass analyzer.

10. A mass spectrometer as in claim 1, wherein the second mass analyzing means is one of the group consisting of a magnetic focusing mass analyzer, a time-of-flight mass analyzer, a quadrupole mass analyzer and an ion cyclotron resonance mass analyzer.

11. A mass spectrometer as in claim 2, wherein the first accelerating means provides negative acceleration and the second accelerating means provides positive acceleration.

12. A mass spectrometer as in claim 2, wherein the first accelerating means provides positive acceleration and the second accelerating means provides negative acceleration.

13. A method for analyzing the mass of a material sample, said method comprising:

(a) generating a primary ion beam from the sample;

(b) selecting a beam of parent ions having a predetermined mass distribution from the primary ion beam;

(c) colliding at least a portion of the beam of parent ions with the interior surfaces of an array of microchannels, whereby the parent ions are dissociated into smaller daughter ions;

(d) selecting a fraction of the daughter ions having a predetermined mass distribution; and (e) quantifying the mass fraction of daughter ions.

14. A method as in claim 13, wherein steps (a) through (e) are repeated to select fractions of the daughter ions having different mass distributions to produce a mass spectrum of the daughter ions.

15. A method as in claim 13, wherein the parent ions are collided with the microchannels with an energy in the range from about 0.1 to 2.0 keV.

16. A method as in claim 13, wherein the beam of parent ions is collided with the interior surfaces of the microchannels at angles in the range from about 1° to 10°.

17. A method as in claim 13, wherein the parent ions are selected by one of the group consisting of a magnetic focusing mass analyzer, a time-of-flight mass analyzer, a quadrupole mass analyzer, and an ion cyclotron resonance mass analyzer.

18. A method as in claim 13, wherein the fraction of daughter ions is selected by one of the group consisting of a double focusing mass analyzer, a time-of-flight mass analyzer, and a quadrupole mass analyzer.

19. A method as in claim 13, wherein the parent ion beam is decelerated prior to collision with the microchannels and the resulting daughter ions are accelerated prior to fraction selection.

20. A method as in claim 13, wherein the parent ion beam is accelerated prior to collision with the microchannels and the resulting daughter ions are accelerated prior to fraction selection.

21. In a mass spectrometer of the type employing a first mass analyzer for selectively producing a parent ion stream, a collision surface for fragmenting the parent ion stream into a plurality of daughter ion streams, and a second mass analyzer for selecting among the daughter ion streams, an improved collision surface comprising a plate having a plurality of microchannels therein, wherein the channels in the plate are oriented to allow incident parent ions to collide with the walls of the channel to induce dissociation into daughter ions.

* * * * *

UNITED STATES PATENT AND TRADEMARK OFFICE

CERTIFICATE OF CORRECTION

PATENT NO. : 4,851,669

DATED : July 25, 1989

INVENTOR(S) : William Aberth

It is certified that error appears in the above—identified patent and that said Letters Patent is hereby corrected as shown below:

Column 1, line 4, insert the following: --The Government has rights in this invention pursuant to Grant No. GM-32315 awarded by the Department of Health and Human Services.--

Signed and Sealed this

Twenty-sixth Day of June, 1990

*Attest:*

*Attesting Officer*

HARRY F. MANBECK, JR.

*Commissioner of Patents and Trademarks*